United States Patent [19]

Brandewie et al.

[11] 4,380,117

[45] Apr. 19, 1983

[54] ELECTRICAL HARNESS FABRICATING APPARATUS

[75] Inventors: Joseph E. Brandewie, Dunedin; Granville S. Hart, Clearwater, both of Fla.

[73] Assignee: AMP Incorporated, Harrisburg, Pa.

[21] Appl. No.: 267,104

[22] Filed: May 26, 1981

[51] Int. Cl.[3] ..... H01R 43/04

[52] U.S. Cl. ..... 29/742; 29/747; 29/749; 29/753

[58] Field of Search ..... 29/742, 749, 747, 753, 29/754, 759, 795–797, 564.4, 564.6, 564.7, 564.8

[56] References Cited

U.S. PATENT DOCUMENTS

| | | | |
|---|---|---|---|
| 4,175,316 | 11/1979 | Gudmestad | 29/564.4 |
| 4,255,850 | 3/1981 | Tominoi | 29/742 |
| 4,333,230 | 6/1982 | Funcik et al. | 29/749 |

*Primary Examiner*—Carl E. Hall

*Attorney, Agent, or Firm*—F. Brice Faller

[57] ABSTRACT

Apparatus for fabricating a multi-wire harness assembly are disclosed. The harness consists of wires which are first terminated en masse on one level, then loaded en masse into a connector block on a conveyor at a lower level. Wires are then fed to diverse lengths, cut and stripped, and the trailing ends are transported on a conveyorized clamp which parallels the connector block clamp. The apparatus utilizes a shuttle having telescoping wire guide tubes which are directed by a pivotable track first to an operating zone for termination. The shuttle has a clamping mechanism so that the terminated leads are drawn into the expanding tubes as the shuttle retreats. The track then pivots to the level of the connector, the shuttle moves against the connector block to load the terminated leads, and the clamp is released as the shuttle retreats from the block over the wires. A comb-like deflector with arcuate channels moves onto the wires and a remote axial wire feeder pays out the wire through the shuttle to loops of various lengths between the loaded connector block and the deflector.

4 Claims, 21 Drawing Figures

ELECTRICAL HARNESS FABRICATING APPARATUS

BACKGROUND OF THE INVENTION

The present invention relates to a fully automated method and apparatus for manufacturing wiring harnesses.

U.S. Pat. No. 4,363,167 is closely related to the present invention and is hereby incorporated by reference. That patent discloses an apparatus which terminates leads en masse at one spacing and inserts the terminated leads en masse at a smaller center-to-center spacing in a connector block. The apparatus utilizes a shuttle having telescoping tubes containing wires therein at a first fixed spacing which are delivered to an operating zone for termination. The shuttle then retreats on a linear path drawing the terminated leads into the telescoping tubes, a connector is manually placed on said path, and the shuttle moves forward to insert the terminated leads into a connector block.

The apparatus described in U.S. Pat. No. 4,363,167 represents a major advancement in the harness making art. The only prior art machines capable of loading wires en masse into a connector block utilize insulation displacing terminals in the block, e.g., U.S. Pat. Nos. 4,043,017 and 4,136,440. U.S. Pat. No. 4,074,424 discloses apparatus which terminates leads one at a time and inserts the terminated leads one at a time into a connector housing, but does not have the capability of en masse loading.

SUMMARY OF THE INVENTION

The present invention represents an improvement over the apparatus disclosed in U.S. Pat. No. 4,363,167 insofar as a telescoping shuttle which operates on two levels is disclosed. This permits the connector blocks to be supplied on a continuous conveyor for loading on one level while the shuttle pivots to terminate leads on another level. Automated means for clamping the wires in the shuttle while the wires are terminated and loaded are disclosed, as well as means for unclamping wires when the shuttle retreats over the wires after loading the connector block.

The shuttle comprises a header fixed to forward wire guide tubes which collapse into guide tubes in a rear section. The header has wheels journaled thereto which ride in a channel track having a forward portion which pivots upward under the action of a solenoid so the header can extrude wires into an operating zone for termination. The rear section of the shuttle is pivotally attached to a clamping section where the wires are gripped. After wires are terminated, the shuttle retreats, the forward portion of the channel track drops, and the shuttle moves forward with header at the level of the connector block conveyor. The wires are then unclamped and the shuttle retreats to perform other operations on the wire.

It is the principle object of the present invention to provide means for fully automating the production of a wiring harness.

BRIEF DESCRIPTION OF THE DRAWINGS

FIGS. 2A–2I are schematic side views of the sequence of wire feed carriage operations.

DETAILED DESCRIPTION OF THE PREFERRED EMBODIMENT

Figure 1:
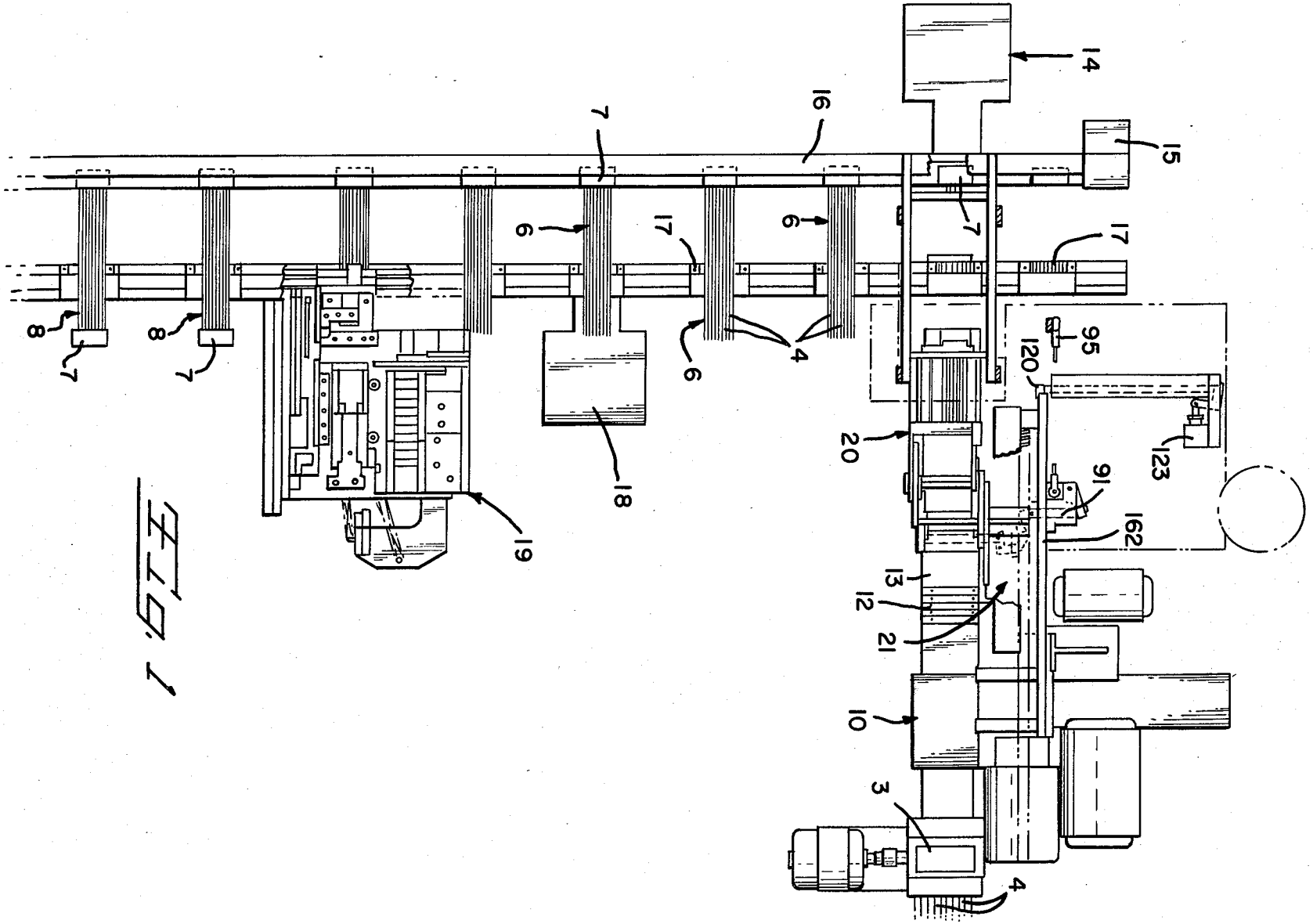
FIG. 1 is a plan view of the harness making apparatus.

The harness making apparatus of the present invention is shown in plan in FIG. 1. Its operation will now be described briefly. Wires 4 are drawn through wire feeder 10 from an endless source such as take-up barrels (not shown), through a pull-back mechanism 3 by telescoping shuttle 20 which clamps the wires and delivers them to leading end press 14 where the leads are terminated. The shuttle then retreats while the clamp is actuated and delivers the terminated ends to a connector block 7 carried on conveyor 16 from block feed 15. The wire feeder 10 is of the type described in U.S. Pat. No. 4,354,626 and the same general arrangement is shown schematically in FIG. 2 of that application. The leading end press 14 is of the type described in U.S. Pat. No. 4,363,167. The shuttle 20 of the present invention utilizes telescoping wire guide tubes and is of the same general type as that described in U.S. Pat. No. 4,363,167, except that it is designed to deliver the wires 4 for termination at a level higher than where the connector blocks 7 are loaded so that a continuous conveyor 16 may be provided to fully automate the harness making.

Referring still to FIG. 1, the trailing ends of wires 4 are then conveyed by a traveling wire clamp 17 on a conveyor which parallels conveyor 16 carrying the loaded block 7. The wires 4 and connector block 7 now constitute a harness 6 which is transported to a trailing end press 18, also of the type described in U.S. Pat. No. 4,363,167, except that the wires are delivered thereto laterally rather than axially. Subsequent to termination, the trailing ends are transported to a block loader 19 where they are mass loaded into a connector block 7 to make a jumper cable 8. The block loader 19 is fully described in U.S. patent application Ser. No. 244,418.

The above brief description describes the manufacture of a jumper cable, i.e., one having a connector block at each end and equal length wires therebetween, and is given to put this application in context with related applications cited above. The instant invention is concerned only with the manufacture of a harness 6, but the trailing ends of varying length wires could be transported to a series of stations for other terminating and loading operations.

Referring now to FIGS. 2A through 2I, the sequence of operation in the automated manufacture of a wiring harness will be described in greater detail. It will be helpful to refer to the timing diagrams, FIGS. 9A and 9B; the parenthetical numbers following Figure numbers 2A–I refer to the timing diagram positions. Dimensionless numbers with FIGS. 2A–D refer to shuttle positions while the degreed numbers with FIGS. 2D–I refer to camshaft positions. Following the FIG. 2 descriptions the linkage used to effect the movements associated with the feed carriage will be described in detail.

Figure 2A:
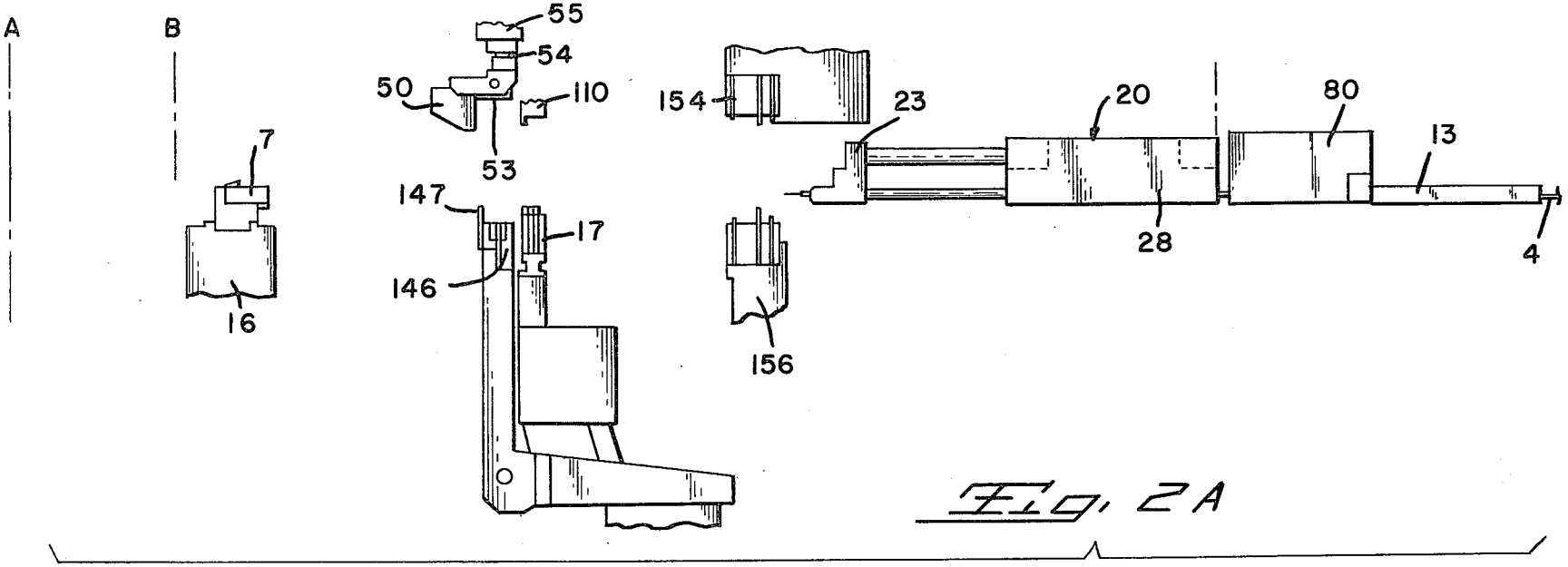
Figure 3:
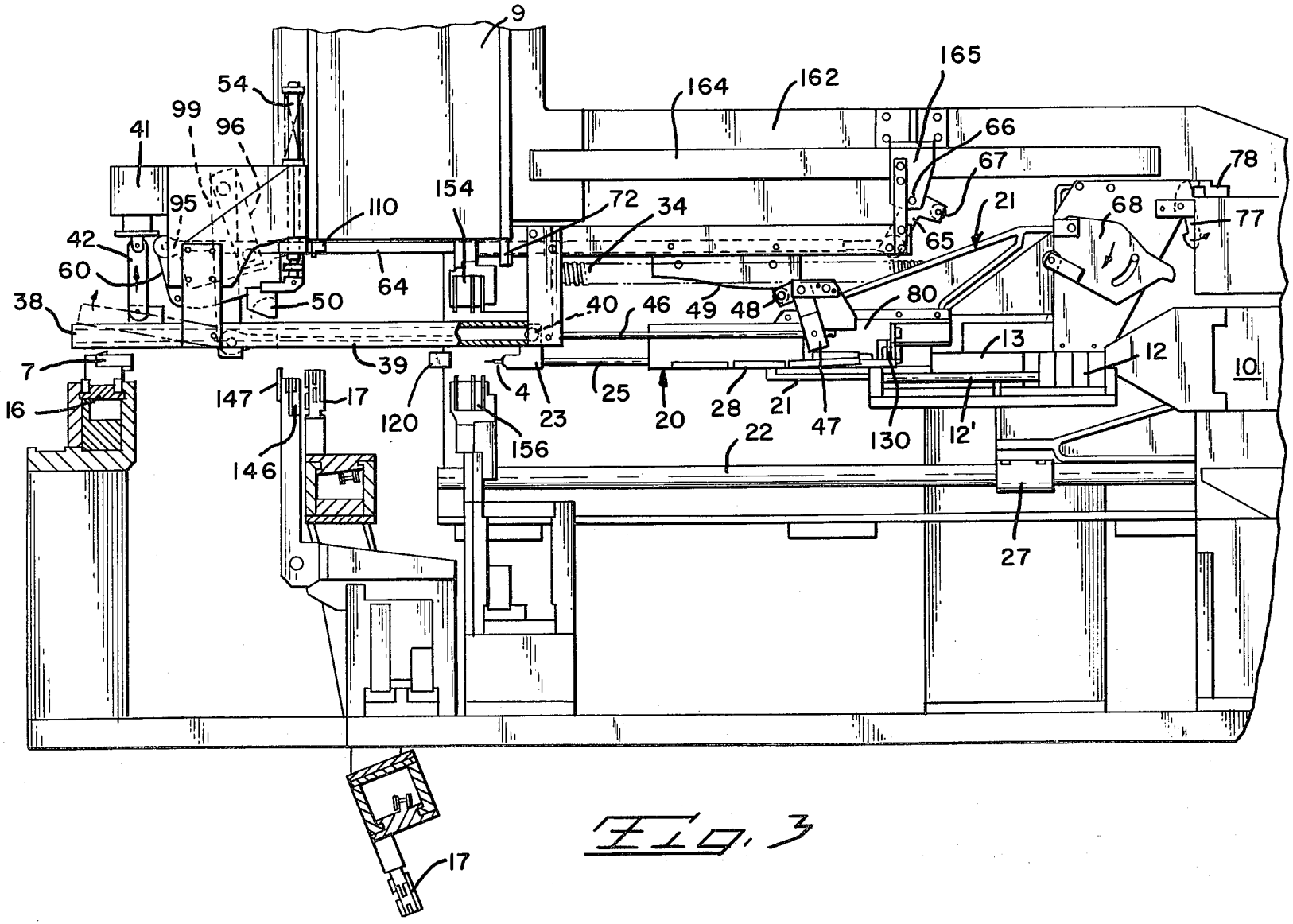
FIG. 3 is a side view of wire feed carriage detailing the header pull back linkage.
Figure 7:
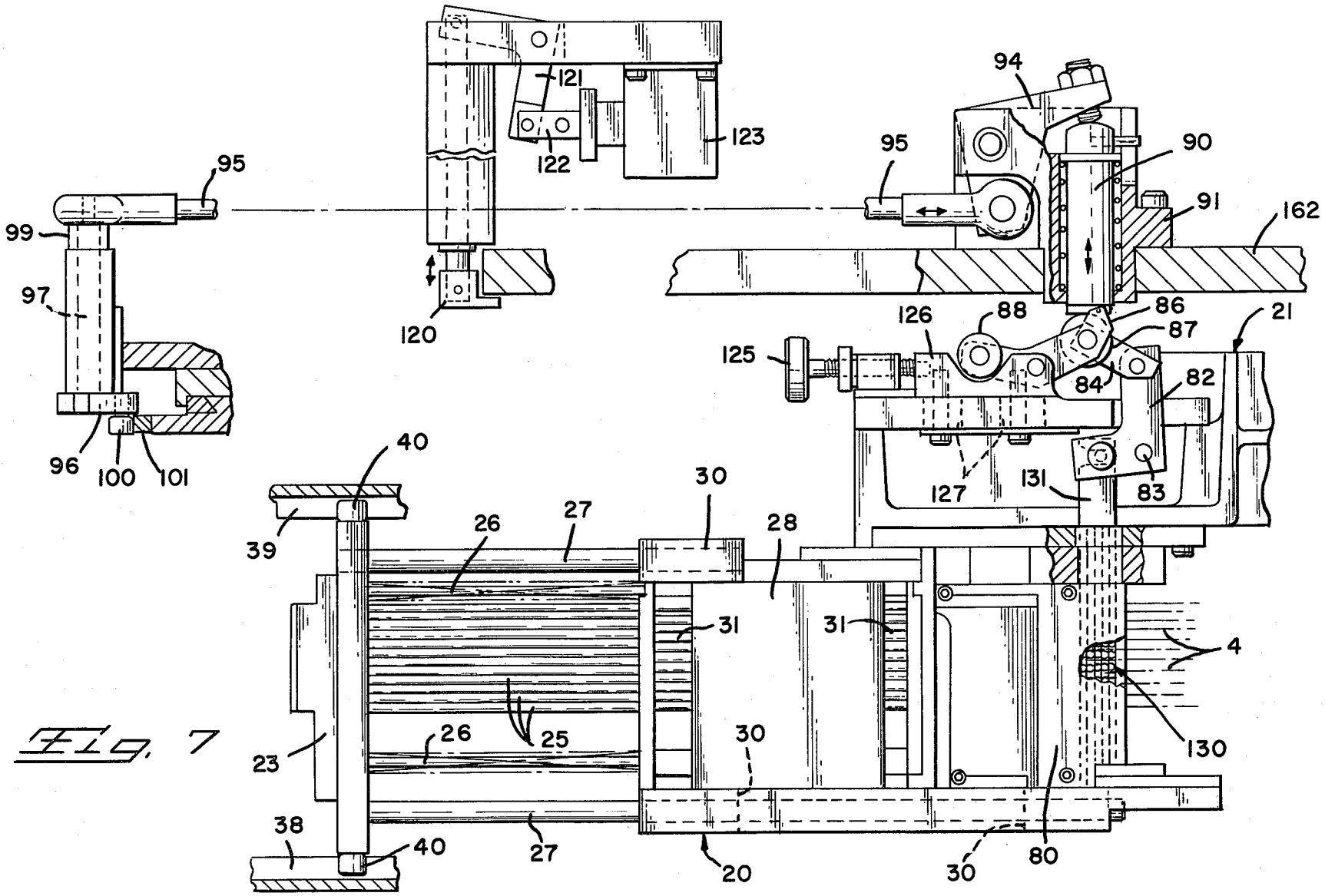
FIG. 7 is a plan view of the carriage and clamp linkage.

FIG. 2A (0) is a schematic of the shuttle 20 which comprises a header 23, a rear section 28, a clamping section 80, and a horizontal converger 13. The wires 4 are releasably gripped in clamping section 80 and pass through guide tubes 31 in rear section 28 (visible in FIG. 7) and through inner or forward guide tubes 25 to header 23. The leading ends of the wires protrude from ports in the header as the inner or forward wire guide tubes 25 telescope into the rear or outer wire guide tubes 31 (FIG. 7) under the action of the header pull back cam 49 (FIG. 3). Outboard guide rods 27 are arranged to be received in ball bushings 30 on the rear section 28 (FIG. 7). The upper cut and strip blade assembly 154 and lower cut and strip blade assembly 156 are poised to allow the shuttle 20 to pass therebetween, as are the deflector 50 and pin clamp 146, and ram 110 and traveling wire clamp 17.

Figure 2B:
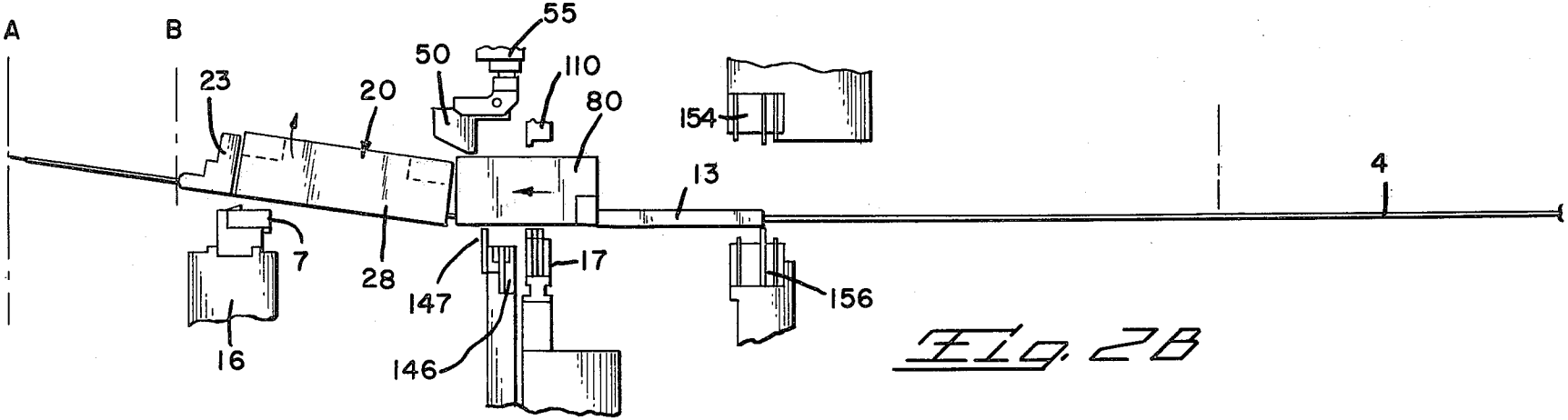

FIG. 2B (4½) shows the shuttle 20 at its forwardmost position. The header 23 is against a wire spreading template (not shown) which causes the tubes to telescope so that the rear section 28 comes up adjacent to header 23 and the wires emerge for termination as described in U.S. Pat. No. 4,363,167, which is hereby incorporated by reference. Line A—A on FIG. 2A et seq refers to the center line of the applicator which terminates terminals to wires as described in that application. Line B—B on FIG. 2A et seq refers to the compensator package which the header abuts to extrude wires as described in that application. The rear section 28 is pivotably connected to the clamping section 80 by a leaf spring so that the header 23 and rear section 28 will clear the connector block 7 and the block conveyor 16. The rear section 28 is pivoted by means of a channel track which guides followers on the header 23 to be discussed in conjunction with FIGS. 3 and 4. The horizontal converger 13 mounted behind the clamping section 80 modifies the center line spacing of the wires from that of the wire feeder 10 to that of the rear guide tubes 31.

Figure 2C:
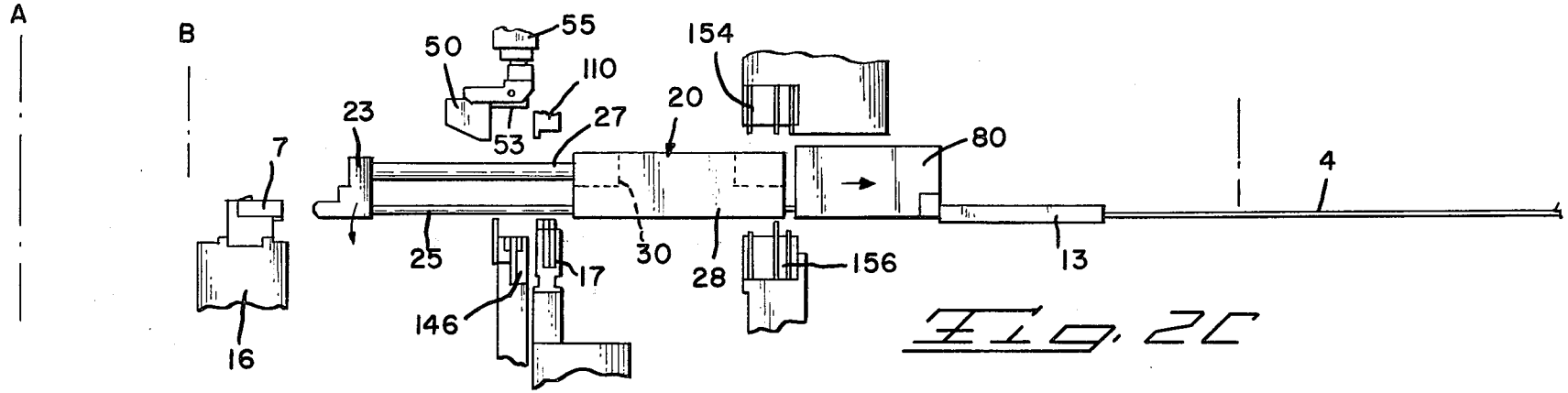

FIG. 2C (8½) shows the shuttle 20 as it retreats after termination. The inner telescoping tubes 25 have expanded from the rear section 28 to draw the terminated ends into header 23 so that the terminals are flush with the ports in the header. Note that the header also passed through this stage between FIGS. 2A and 2B. The clamping section 80 still grips the wires firmly while the trailing portions of the wires are drawn rearward with the motion of the shuttle by wire pull back apparatus 3 (FIG. 1). The header 23 drops with the channel track 38 (FIG. 4) when the header clears the block conveyor 16 so that the terminated ends therein are aligned with connector block 7.

Figure 2D:
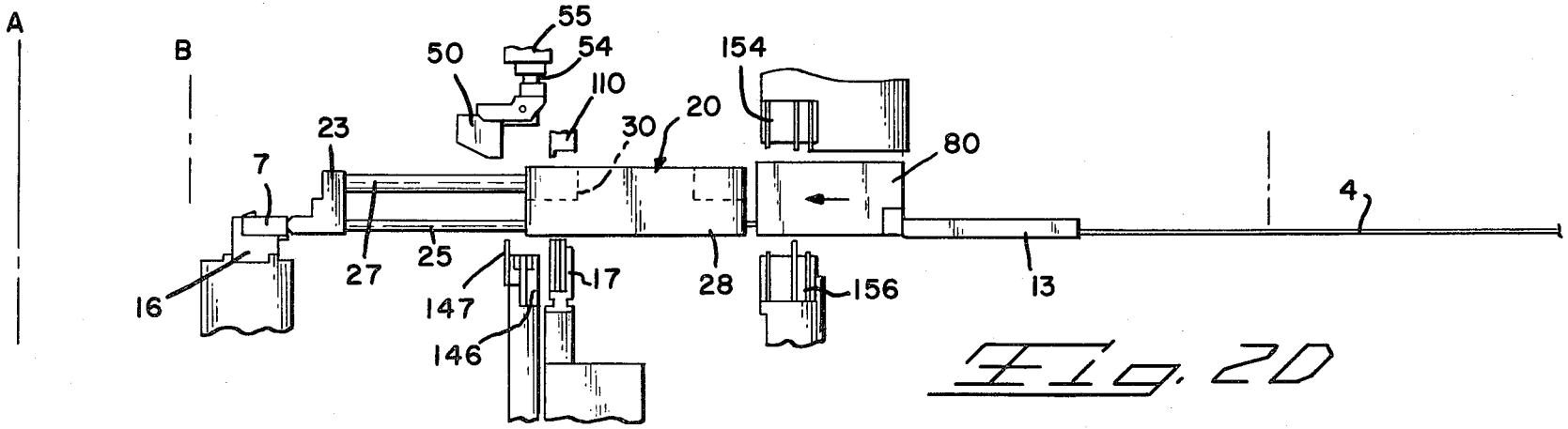
Figure 2E:
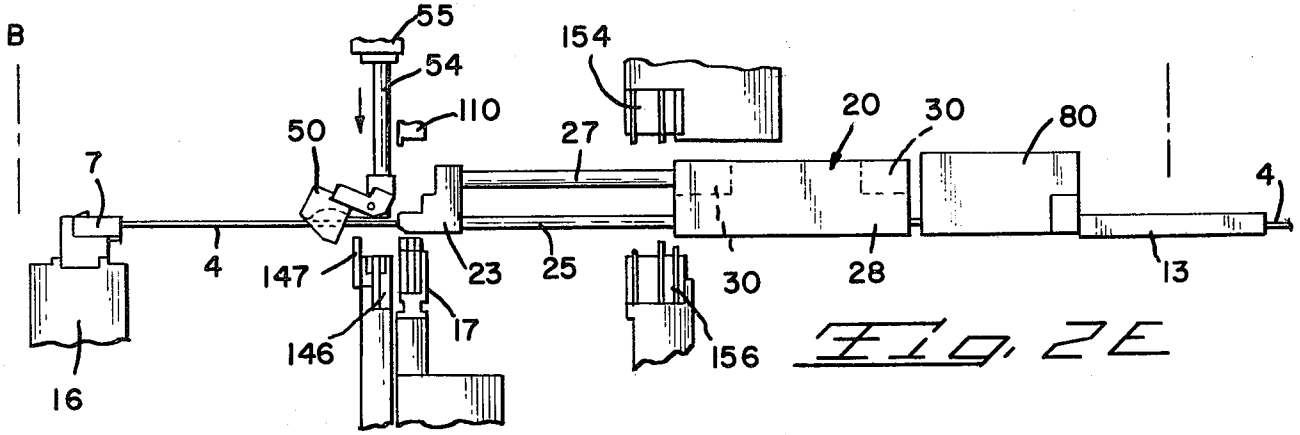

FIG. 2D (9) depicts the header 23 collapsed somewhat toward the rear section 28 of shuttle 20 as the shuttle moves forward to load the terminated ends into connector block 7. In FIG. 2E (12 ) the clamping mechanism in the clamp section 80 has released the wires 4 so that the shuttle 20 can retreat over the wires while the leading ends are held in connector block 7 by spring lances on the terminals. The retreat of the shuttle 20 mechanically actuates deflector 50, causing it to drop down from housing 55 on slide shafts 54 against the taut wires. The deflector has separators 51 separating arcuate channels 52 (FIGS. 4 and 6) which capture the wires to maintain the spacing.

Figure 2F:
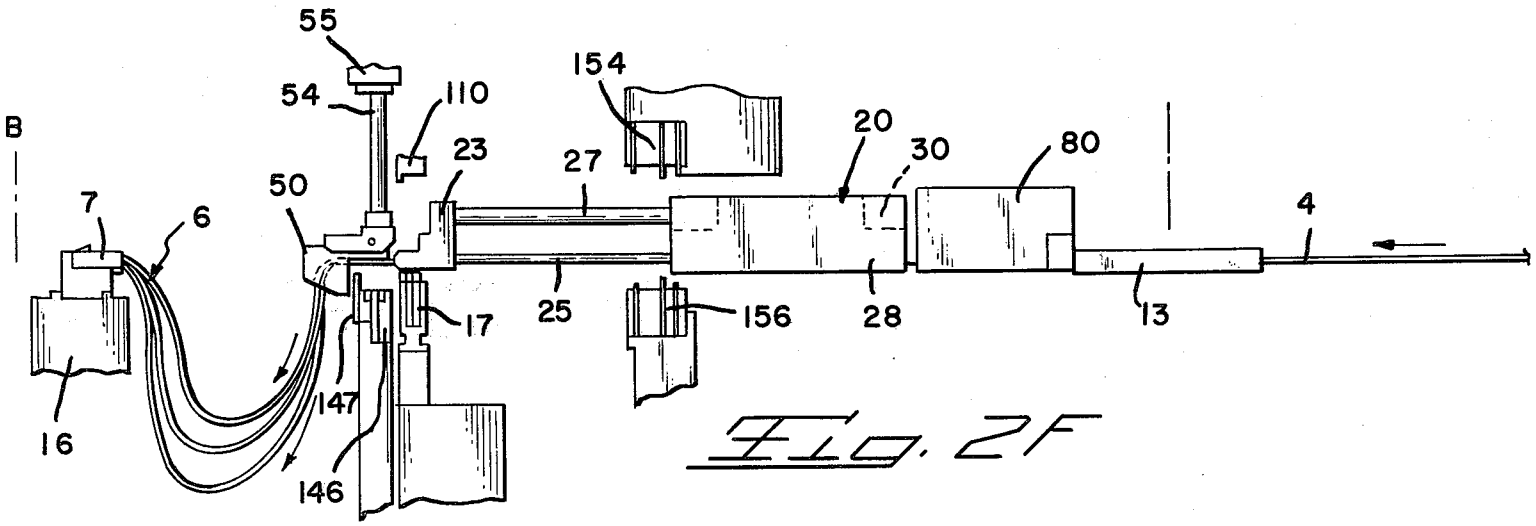

In FIG. 2F (0) the shuttle 20 and other mechanisms in this view dwell while the wire feeder 10 (FIG. 1) feeds the wires to various lengths determined by a programmed controller of the type described in U.S. Pat. No. 4,043,494. The deflector 50 is spring loaded against the wires so that it pivots downward as the wires are fed and tautness is relieved, deflecting the wires into loops as shown. Thus the axial wire feed at a remote point combined with guide tubes intermediate and a comb-type deflector with arcuate channels are effective to pay out wires to desired lengths and direct them into loops clear of the apparatus.

Figure 2G:
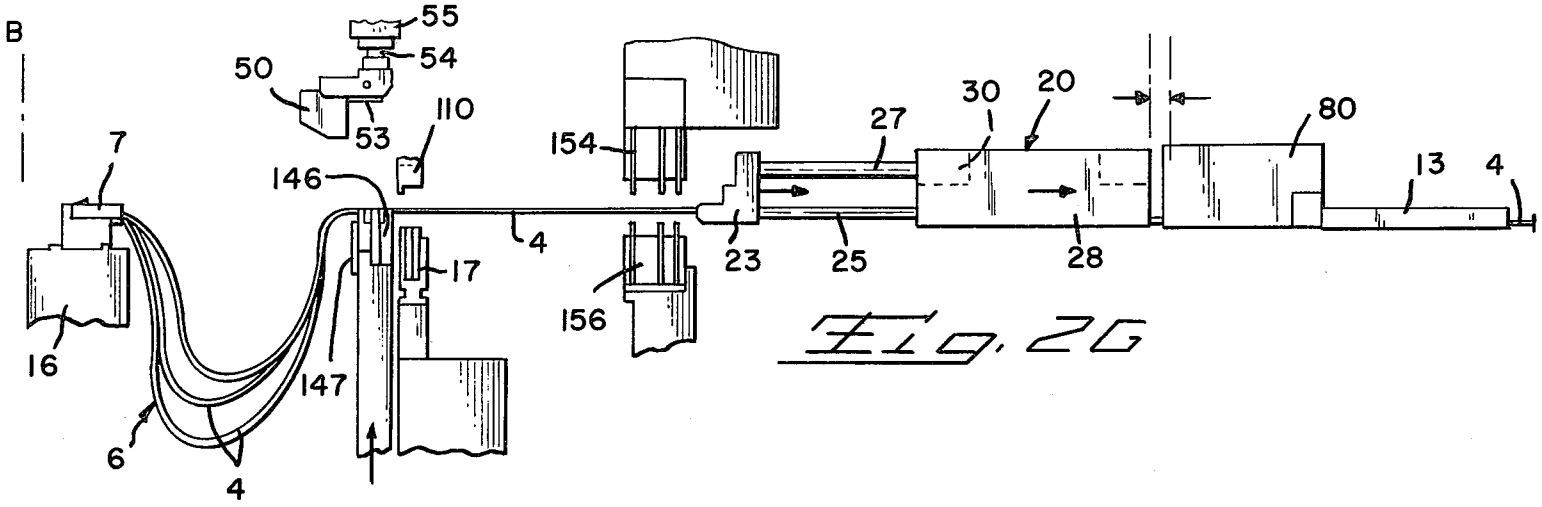

In FIG. 2G (85°) the shuttle has returned to the cut-off position while the upper and lower cut-off heads 154,156 approach the wires 4. The lower arm pin clamp 146 has risen to capture the wires from 5° to 40°, the pins therein close on the wires from 40° to 65°, and the deflector 50 is drawn upward during carriage retreat while the camshaft dwells at 70°. The movement of the deflector 50 is effected by the action of a shuttle mounted cam during the rear movement of shuttle 20 as will be discussed in conjunction with FIGS. 3 and 4. The vertical movement of the pin clamp 146 and closing of pins therein are effected by rotation of a camshaft, the motion of which is described in degrees. The deflector 50 is mounted to a ram 53 which is flat on the bottom and acts to ram the wires 4 into the pin clamp 146 before the deflector 50 travels upward. The header 23 is pulled back toward the rear section 28 by shuttle actuated linkage while the cam shaft dwells at 70°, as will be discussed in conjunction with FIG. 3, while the clamping mechanism in the clamping section 80 of the shuttle is actuated from 70° to 80°.

Figure 2H:
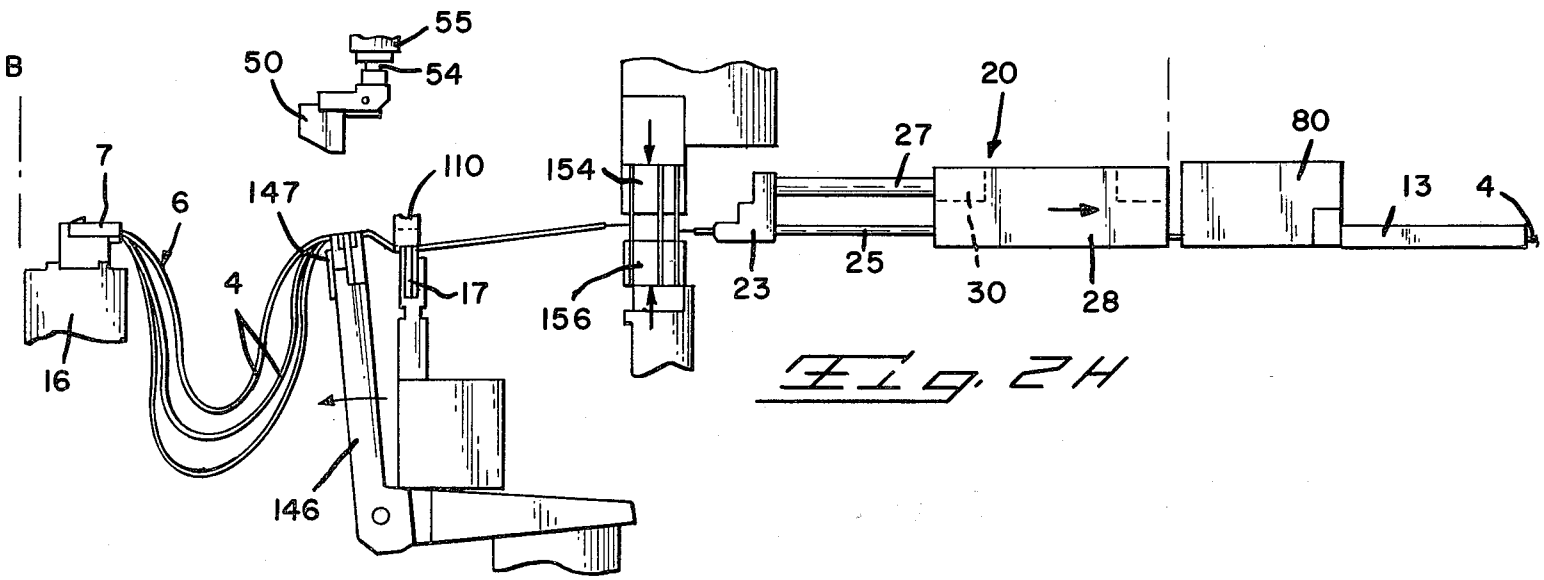
Figure 27:
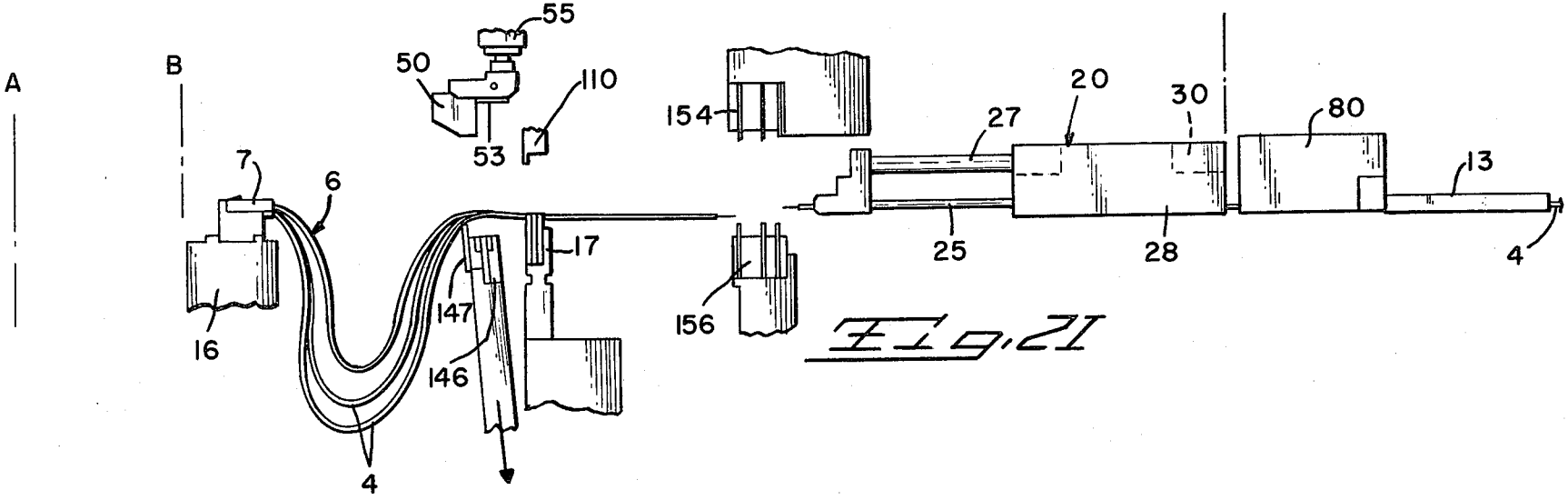
Figure 8A:
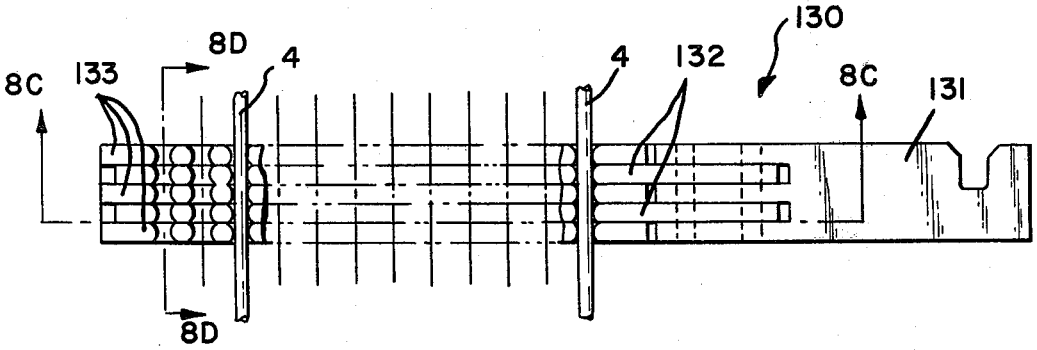
FIGS. 8A and 8B are a plan view of the carriage clamp.

FIG. 2H (170°) depicts the apparatus at the completion of the cut and strip operation and prior to clamping the wires into traveling wire clamp 17. The upper and lower cut off heads 154, 156 have come together to cut the wires 4 by 140° and the pin clamp 146 pulls left to strip the trailing ends of the wires in the harness 6 from 140° to 170° while the shuttle pulls to the right to strip the wires 4 from 140° to 160°. Ram 110 comprises a comb member spring loaded onto the lower end of an inserter. FIG. 2H shows the comb descended to separate the wires immediately before the inserter falls (170° to 195°) to insert the wires into the traveling clamp 17 and clamp the wires therein by acting on a lever which shifts the clamping pins. The clamp is of the same type as pin clamp 146 and the shuttle clamp described in conjunction with FIGS. 8A and 8B. The header 23 remains pulled back toward rear shuttle section 28 more than the distance the length of wires are exposed from the header, which allows space in the header 23 for alignment of crimped terminals on the leading ends of wires 4. The terminals are flush with the face of the header 23 while the ends of the wires are 9/16 inch inside.

In FIG. 2I (315°) the pin clamp 146 has unclamped the harness 6, and partially lowered away from the harness, but does not return from the wire stripping position until 360°. Ejector bar 147 remains up to eject wires from the pin clamp 146. The lower cut and strip head 156 is fully descended while the upper cut and strip head 154 is about halfway ascended. The wire placement ram 110 is partially ascended leaving the wires gripped in traveling clamp 140, which subsequently progresses parallel to block conveyor 16 until replaced by the next unloaded block 7 and traveling clamp 17 in readiness for the next operation.

The movements described above are effected by two basic mechanisms: a ball and screw drive on the shuttle, and a cam shaft. The cam shaft effects the motions of the pin clamp 146 and cut and strip head 156, and, by means of a main slide in slide housing 9 (FIG. 4), the ram 110 and cut and strip head 154. The main slide (not shown) has several cam surfaces which act on followers carried by linkage for the various motions. The ball and screw drive operates the shuttle intermittently, while the camshaft dwells. The shuttle motion operates the deflector and header pull back by direct linkage, while the header lift track is operated by a solenoid. The shuttle pin clamp is secured by means of linkage, crank arm and plunger through a toggle device mounted inside the shuttle (FIG. 7), while the unclamp unit is operated by a solenoid (FIG. 7).

FIG. 3 is a detailed side view of the wire feed shuttle 20 in the position of FIG. 2A. The shuttle 20 is mounted to frame 21, which is journaled to cylindrical guide rail 22 by pillow block 27. The pillow block contains a ball bushing having recirculating balls which permit low friction linear movement of the frame 21. Header 23 has wheels 40 mounted thereon which ride in rear channel tracks 39 and forward channel tracks 38 (see also FIG. 7). The forward channel tracks 38 are connected to solenoid 41 by link 42 so that the header 23 may be pivoted upward to the position of FIG. 4. The header 23 is shown pulled back toward the rear section 28 by pull back rod 46, which is connected to the header 23 at the forward end and pivotably to a bell crank 47 at the rear end. The bell crank 47 is carried pivotably on the shuttle frame 21 and carries a cam follower 48 arranged to ride on cam surface 49 which is fixed on horizontal mounting bar 163. Thus, as the shuttle 20 moves forward from the position shown, the header 23 expands away from the rear section 28 under the action of springs 26 (FIG. 7) so that the leading ends of wires 4 recede into the header.

FIG. 3 also depicts the shuttle actuated linkage for the deflector 50. This includes forward bell crank 60, connecting rod 64, and rear bell crank 65 which is pivotably mounted to stationary clevis member 165 at fulcrum pin 66. The rear bell crank 65 carries a cam follower 67 which is acted on by cam block 68 to lower deflector 50 as the shuttle 20 retreats to the position of FIG. 2E, after loading the terminated wires in a connector block. When the shuttle is fully retreated after the wire stripping operation as shown in FIG. 2H, the cam block 68 is pivoted downward by the action of lever 77 hitting stop 78 on the stationary frame. The deflector linkage will be discussed in greater detail in conjunction with FIG. 4.

Referring still to FIG. 3, the screw drive 34 for the shuttle 20 is also visible. This is rotated a predetermined number of times for each movement of the shuttle and bears on a ball nut carried in the frame 21, causing the balls to ride through the screw thread to move the shuttle. Other shuttle components visible in this view are the forward wire guide tubes 25, rear section 28, clamping section 80 with pin clamp 130, and the horizontal converger 13. Behind the converger is the collapsable wire guide 12, which expands on a pair of rails 12' as the shuttle 20 moves forward. The shuttle clamp 130 is actuated by motion of the main slide in cam bank 9, which has an external cam slide which moves down to pivot lever 96 which in turn pivots lever 99 to draw connecting rod 95 forward to actuate the clamp 130. This linkage will be described in greater detail in conjunction with FIG. 7.

Also apparent in FIG. 3 are the conveyor 16 for the connector block 7 and one of the traveling wire clamps 17, another of which is shown on the conveyor return path below. The upper cut and strip head 154, lower cut and strip head 156, and wire insertion ram 110 for the traveling wire clamp 17 are also visible in this view. Details of the cam actuated linkage for the pin clamps 17,146 and cut and strip heads 154 and 156 will not be discussed in this application; while actuated by purely mechanical linkage comprising a cam shaft and a main slide in slide housing 9, these elements could also be actuated by solenoids or pneumatics at the signal of a controller.

Figure 4:
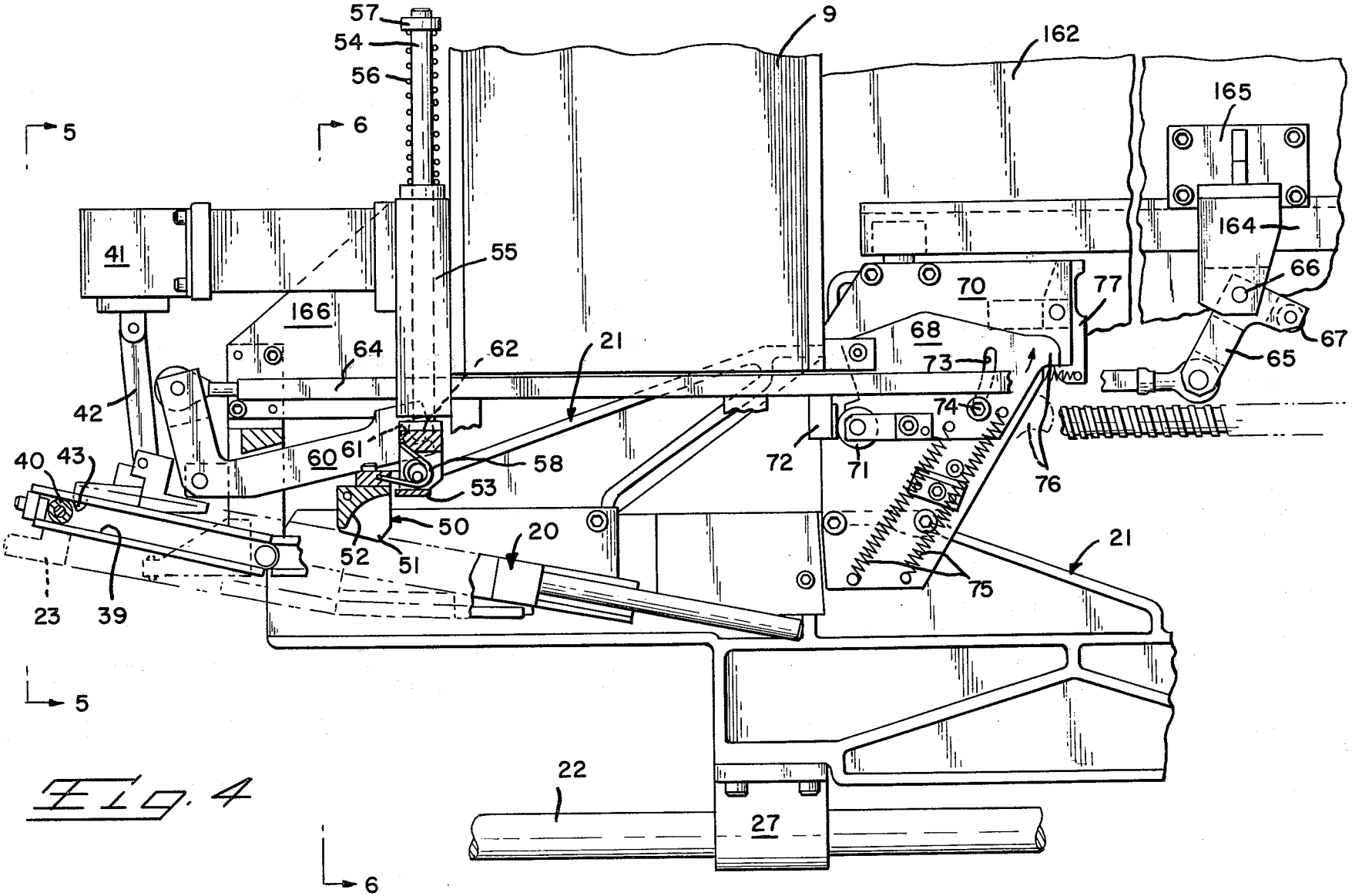
FIG. 4 is a side view detailing the hinged carriage and wire deflector linkage.

FIG. 4 shows the shuttle in the forward position with the forward channel tracks 38 tilted upward and the header 23 retracted fully toward rear section 28 so the wires are extruded into the leading end press 14 (FIG. 1) for termination. The forward guide rods 24 are pushed back through ball bushings 30 on rear section 28 and the wheel 40 is trapped in the end of forward channel tracks 38 by a spring loaded latching pawl 43. The pawl 43 assures that the header 23 expands fully from the rear section 28 when the shuttle 20 retreats, so that the terminals on the wires will enter the ports in the header and be aligned for proper loading into the connector block. The holding force applied by pawl 43 to wheel 40 is only sufficient to assure expansion of the rear section 28 from the header 23, as the springs 26 (FIG. 7) may not provide sufficient force as they approach full expansion. The positive force supplied by the screw drive is sufficient to unlock the pawl when the telescoping tubes are fully expanded.

The deflector linkage is shown in detail in FIG. 4. The deflector 50 is pivotably mounted to ram 53 and is held resiliently downward in the position shown by spring 58. Arcuate channel 52 is shown in section with one of the channel separators 51. The ram 53 is fixed to slide shafts 54 which move vertically in slide housing 55. The ram 53 is urged resiliently upward by springs 56 between the housing 55 and stops 57 adjustably mounted to the tops of the slide shafts. Downward movement of the ram is effected by bell crank 60 which is pivotably mounted to frame member 166; a clevis slot 61 in the end of the bell crank 60 acts on a roller 62 journaled to the ram. The bell crank 60 is pivoted to lower the deflector 50 by rearward movement of connecting rod 64, which is effected by the pivoting of rear bell crank 65, which is pivotably mounted to frame member 105. The rear bell crank 65 carries a follower 67 which is acted on by cam block 68. The cam block 68 is pivotably mounted to mounting plate 70 which is fixed to shuttle frame 21, so that rearward motion of the shuttle 20 causes the deflector 50 to fall as follower 67 rides on cam block 68. The cam block 68 is pivoted to the position of FIG. 4 from the position of FIG. 3 as roller 71 hits stop 72 and spring loaded latch 77 catches the cam 68. The cam block is released when the shuttle is fully retreated, as previously described, and urged clockwise by springs 75. Pin 74 in slot 73 stabilizes the rotation of cam block 68.

Figure 5:
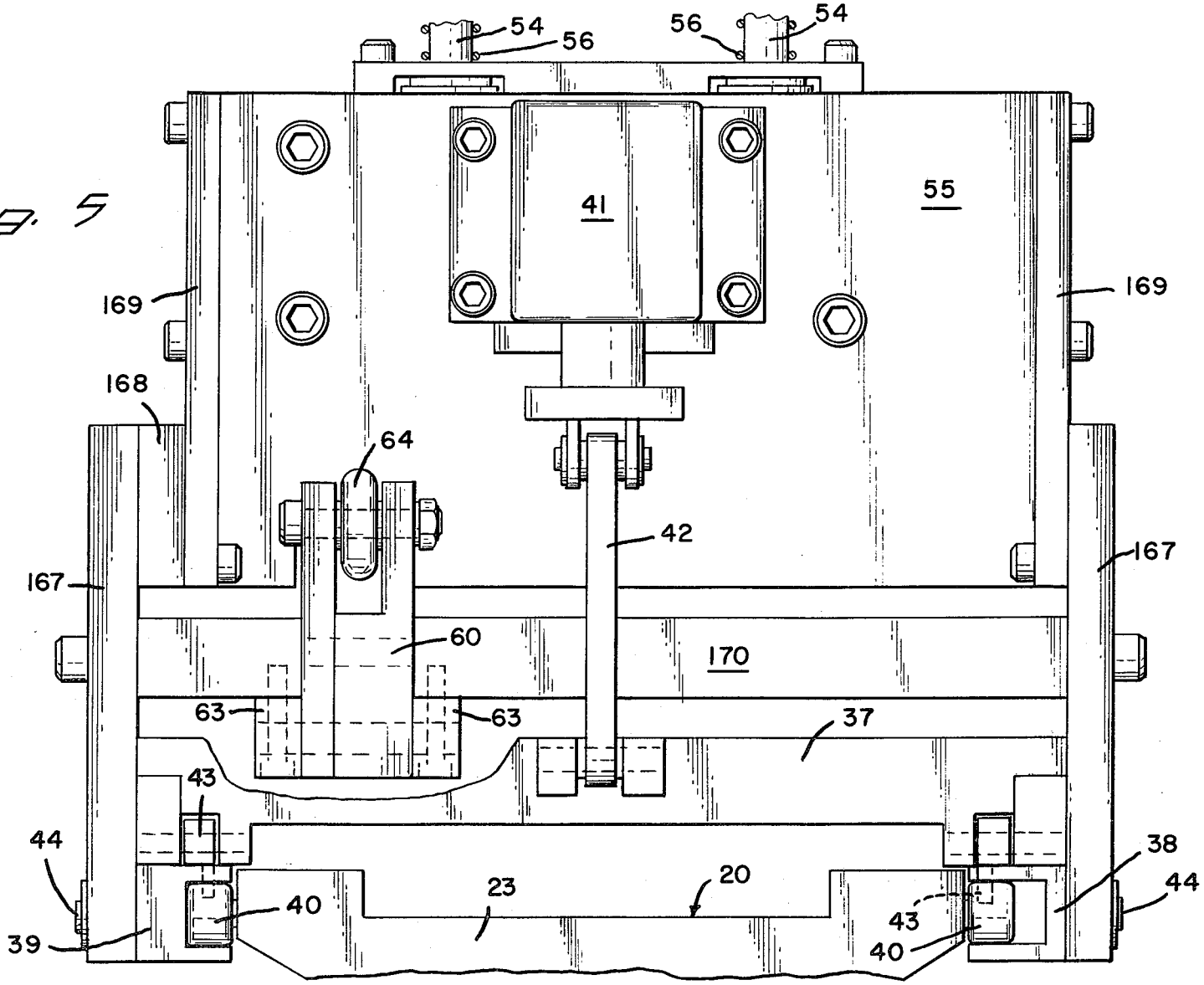
FIG. 5 is an end fragmentary view taken along line 5—5 of FIG. 4.

FIG. 5 is an end fragmentary view taken along line 5—5 of FIG. 4, showing the forward channel track 38 in the lowered position. Gusset plates 169 on either side of housing 55 serve as mounts for track pivot support bars 167. The rear bar 167 is spaced from the rear gusset plate by spacer 168. Pivot pins 44 permit the forward channel tracks 38 to pivot as solenoid 41 acts on link 42 to move channel track tie bar 37 so that header 23 may move up to terminate or straight ahead to load terminated wires into a connector block. Latching pawls 43 are pivotably attached to the tops of respective forward channel tracks 38. Also apparent in FIG. 5 are the connecting rod 64 and bell crank 60 for the deflector 50 (not visible). The bell crank 60 is pivotably mounted between pivot blocks 63 which are in turn bolted to the bottom of tie bar 170. The tie bar 170 extends between track pivot support bars 167.

Figure 6:
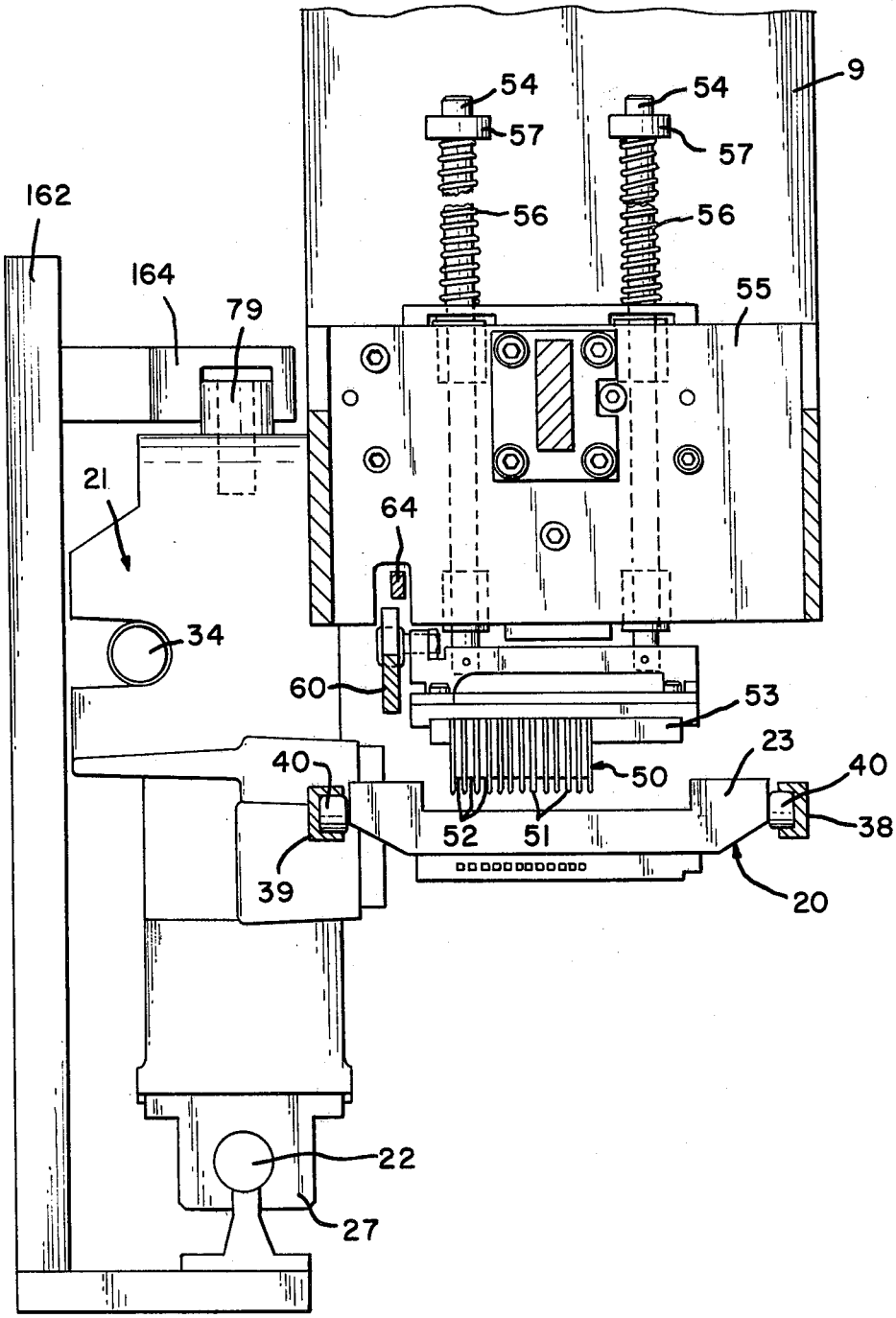
FIG. 6 is a fragmentary section taken along line 6—6 of FIG. 4.

FIG. 6 is another end fragmentary view, taken along line 6—6 of FIG. 4, showing the deflector 50 in the raised position and the shuttle drive means. The shuttle frame 21 has pillow block 27 fixed to the bottom thereof to support the frame 21 and guide its travel. The frame 21 is driven by screw 34, and the travel is stabilized by stabilizer block 79 riding in follower track 164 which is bolted to frame member 162 (also visible in FIG. 4).

The shuttle 20 is shown in plan in FIG. 7 with the linkage for actuating shuttle clamp 130. Levers 96, 99 are fixedly connected by shaft 97 as also appears in FIG. 3. Downward motion of cam plate 101 against follower 100 causes connecting rod 95 to move left which pivots bell crank 94, which in turn bears on clamp plunger 90 to actuate the clamp 130. The plunger 90 is carried in housing 91 which is fixed to vertical mounting plate 162. The plunger 90 acts on clamp roller 87 to lock toggle 86 in the clamped position; the toggle is pivotably connected to bell crank 82 by link 84. The crank 82 pivots about pivot pin 83 which is fixed to shuttle frame 21 in order to throw the clamping slide 131 to grip the wires. This occurs at about 75° in the cam shaft cycle, right after the wires are fed and the deflector is raised by the retreat of the shuttle to the wire cut off position. The wires stay clamped until a connector block is loaded with terminated wires during the next cycle.

Referring still to FIG. 7, the wire clamp 130 is unclamped by action of solenoid 123, which by means of a link 122 and bell crank 121 actuates unclamp plunger 120. This hits unclamp roller 88 on the opposite end of the toggle 86 from clamp roller 87. The shuttle dwells briefly as the roller 88 is adjacent to plunger 120. The throw of clamping slide 131 is adjusted by means of screw 125, which determines the position of toggle mounting block 126. The toggle mounting block 126 is bolted to frame 21 through elongated slots 127 in the frame to permit adjustment. Thus the force with which wires are gripped is adjustable.

Figure 8B:
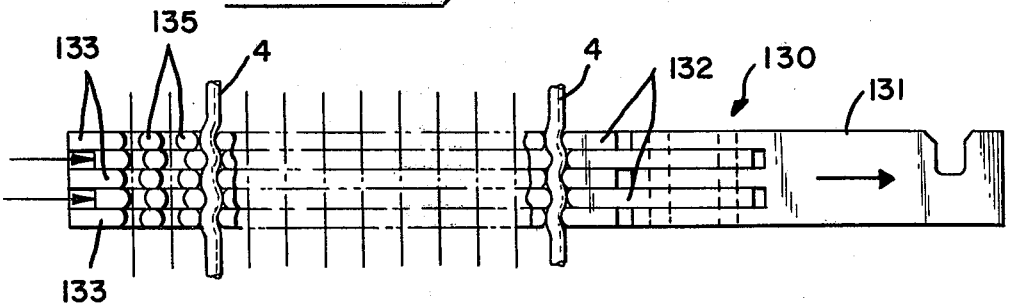
Figure 8C:
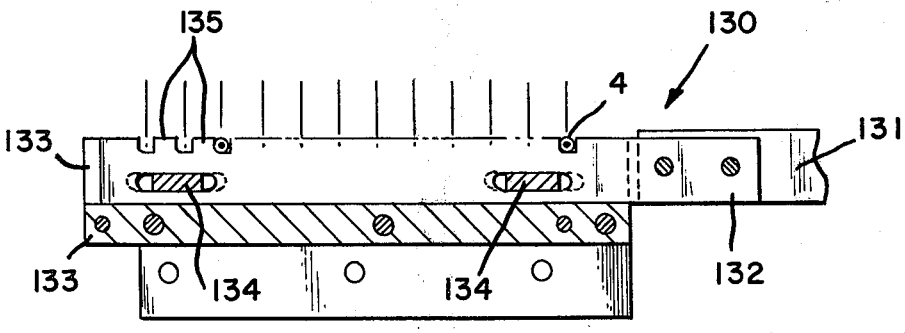
FIG. 8C is an elevation view of the carriage clamp.
Figure 8D:
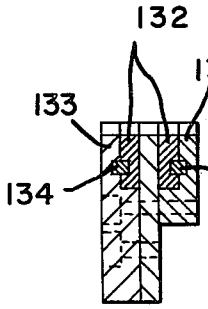
FIG. 8D is a side elevation of the carriage clamp.

FIGS. 8A to 8D show the clamp 130 and its operation in greater detail. The clamping slide 131 is pinned to two movable plates 132 which slide between three stationary plates 133. The plates have machined channels in their sides profiled to maintain keys 134 between the plates to permit relative sliding motion while preventing the plates from coming apart. The plates and keys are held together to comprise shuttle clamp assembly 130 by bolts through the stationary plates 133 below the sliding plates 132. The shuttle clamp is a five pin clamp, so called because each wire 4 is acted on by five pairs of pins 135 as shown in FIG. 8B. The pins 135 kink the wires 4 which, due to the stiffness of the wires, prevents axial movement when axial force is applied, as during wire stripping. The pins have arcuate cuts in their lateral surfaces which aid in gripping the wires between the pins. The pin clamp 146 is also a five pin design, while the traveling wire clamp 17 is a three pin clamp having one movable plate and two stationary plates.

In addition to having adjustments which vary the gripping force on wires, the pin clamps are replaceable to allow for different size wire. This is also true of other components such as the telescoping wire guide tubes 25, 31. Where wire gage is large or center-to-center spacing is close, the rear guide tubes 31 (FIG. 7) may be replaced by a block of metal with bores machined therein which receive the forward guide tubes 25. The bores may overlap slightly so that the walls of forward guide tubes 25 are as close as possible.

Figure 9A:
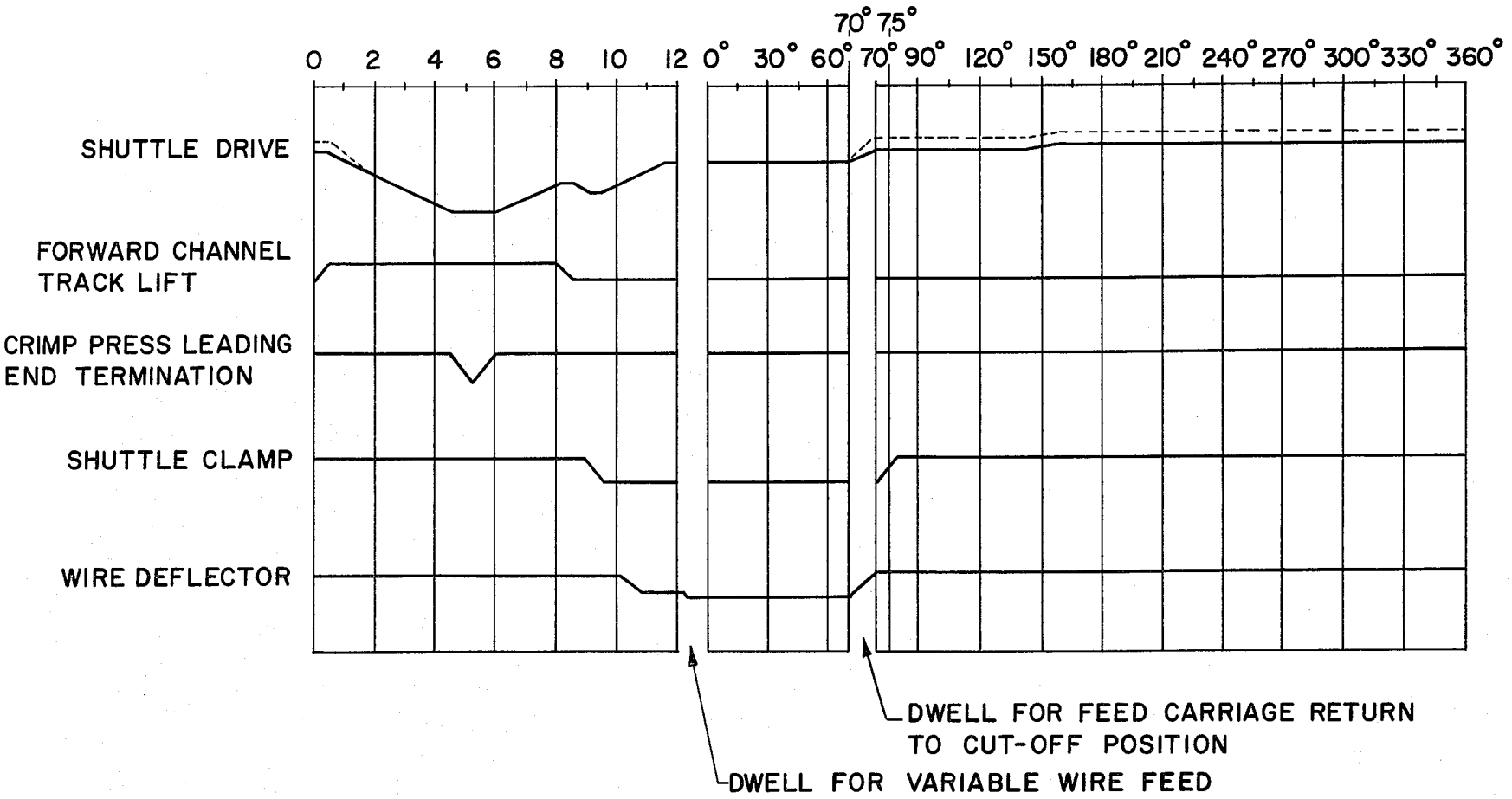
FIGS. 9A and 9B are timing diagrams.
Figure 9B:
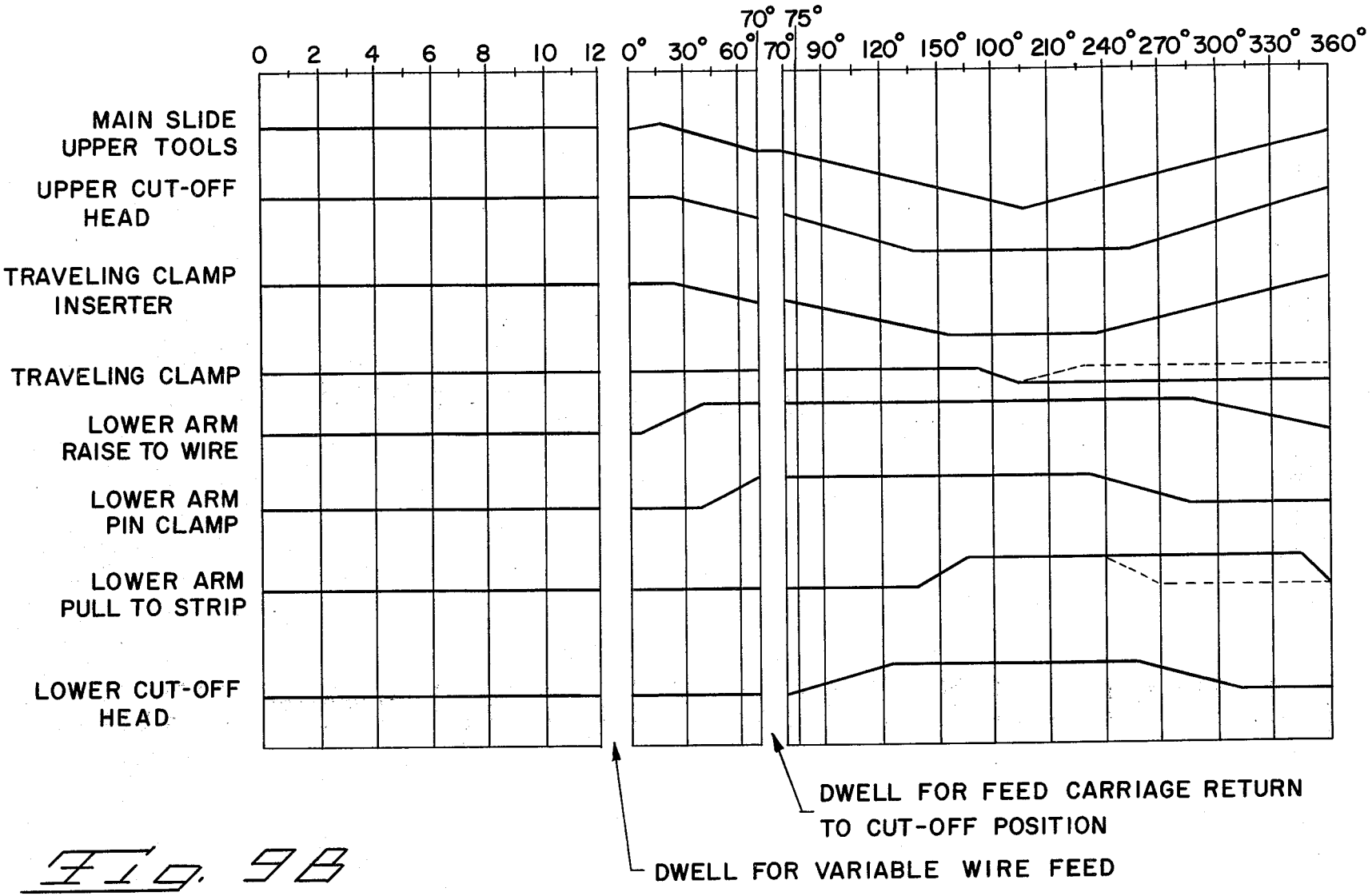

FIGS. 9A and 9B are timing diagrams of a single cycle of the apparatus. The first time block in each diagram is scaled with dimensionless numerals one to twelve. Here the operations performed are determined by shuttle position; the time for each movement is of no consequence. The second and third time blocks on each diagram are scaled in degrees which correspond to the position of a cam shaft behind cam bank 9; all operations shown on FIG. 9B are controlled by the position of the cam shaft. The feed carriage dwells while the cam shaft is in motion, except at 150°, when it moves slightly to strip the wires while the pivot arm clamp 146 strips the trailing ends of the harness.

The stopping and starting of the feed shuttle and cam shaft are controlled electronically by a microprocessor. Sensors mounted on rail 164 (FIG. 6) and on the cam shaft sense the positions of the shuttle and cam shaft so that the next motion is effected. Interlocks are provided in the system so that failure to complete a given step will result in that motion being repeated or shutting down the apparatus until an operator can resolve any difficulties.

The foregoing description is exemplary and not intended to limit the scope of the claims which follow.

We claim:

1. Improved apparatus for terminating the leading ends of a plurality of wires to a like plurality of terminals in a linear array and inserting the terminated leads into a linear array of cavities in a connector housing, said apparatus being of the type having an operating zone having a terminating station therein, an insertion station where terminated ends are inserted into a connector housing, and a reciprocable wire delivery shuttle having telescoping wire guide tubes and releasable wire gripping means thereon, characterized in that said shuttle is reciprocable on a first path from said operating zone to a point remote therefrom, said shuttle being reciprocable on a second path from said insertion station to said point remote from said operating zone, said first path and said second path being colinear along part of their lengths proximate to said remote point, said paths diverging obliquely as they approach the respective stations, whereby, said shuttle positions said leading ends for terminating at said terminating station, retreats therefrom along said first path without passing through said insertion station, and advances along said second path to insert the terminated ends into said cavities in said connector housing.

2. The apparatus of claim 1 wherein said shuttle has a pivotable portion which is pivotable to follow either path and a non-pivotable portion confined to motion along said colinear part of said paths.

3. The apparatus of claim 1 which further comprises a conveyor which transports connector housings along a third path to said insertion station, said third path being substantially normal to the plane formed by the first path and the second path.

4. The apparatus of claim 2 wherein said shuttle is carried by a track, said track having a forward portion which is pivotable to direct said pivotable portion of said shuttle toward either of said stations.

* * * * *